United States Patent [19]

Sherrick

[11] 4,325,510

[45] Apr. 20, 1982

[54] ADJUSTABLE SPRING CLIP

[75] Inventor: James W. Sherrick, Edinboro, Pa.

[73] Assignee: Lord Corporation, Erie, Pa.

[21] Appl. No.: 162,239

[22] Filed: Jun. 23, 1980

[51] Int. Cl.[3] ..... E01B 9/30; E01B 9/46

[52] U.S. Cl. ..... 238/341; 238/282; 238/283; 238/349

[58] Field of Search ..... 238/349, 341, 338, 287, 238/310, 304, 264, 282

[56] References Cited

U.S. PATENT DOCUMENTS

| | | | |
|---|---|---|---|
| 1,571,008 | 1/1926 | Hilpert | 238/282 |
| 3,576,293 | 4/1971 | Landis | 238/287 |
| 3,784,097 | 1/1974 | Landis | 238/310 |
| 3,858,804 | 1/1975 | Hixson | 238/264 |
| 3,888,413 | 6/1975 | Molyneux | 238/282 |
| 3,910,493 | 10/1975 | Wood | 238/349 |
| 3,920,182 | 11/1975 | Molyneux | 238/282 |
| 4,047,663 | 9/1977 | Reynolds et al. | 238/304 |
| 4,062,490 | 12/1977 | Hixson | 238/338 |
| 4,150,791 | 4/1979 | Reynolds et al. | 238/282 |

*Primary Examiner*—Richard A. Bertsch

*Attorney, Agent, or Firm*—Thomas L. Kautz

[57] ABSTRACT

A laterally adjustable rail clip fastening means is provided by the present invention for securing a resilient rail clip such as a Pandrol clip to a direct fixation rail mounting assembly, and, in turn, into engagement with a rail. The rail clip fastening means includes a pair of sections of rigid material formed with a curved portion at one end which receive and securely hold a resilient rail clip in engagement with the rail. Each of the sections are engageable with a disc means rotatably disposed within the top plate of the rail mounting assembly on opposite sides of the rail. The disc means are rotatable to move the sections laterally along the top plate, and include locking means to independently lock such sections into a position against the rail for preventing lateral movement thereof in cooperation with the resilient rail clips.

4 Claims, 5 Drawing Figures

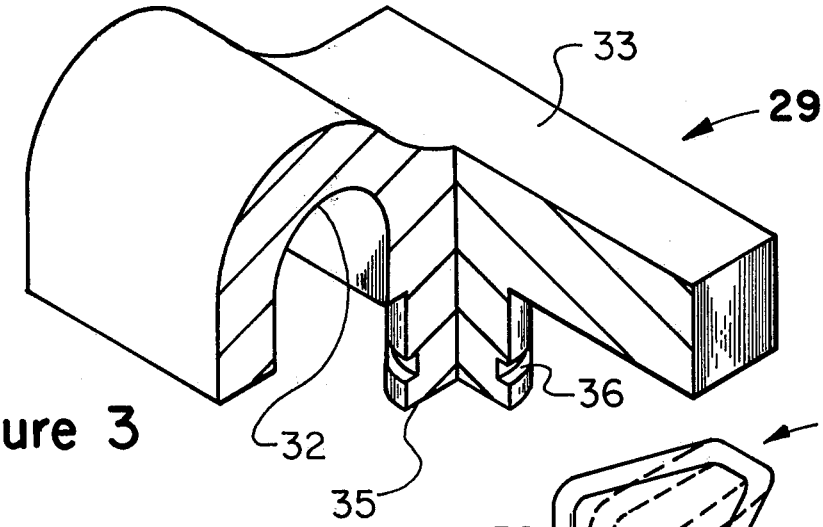
Figure 3
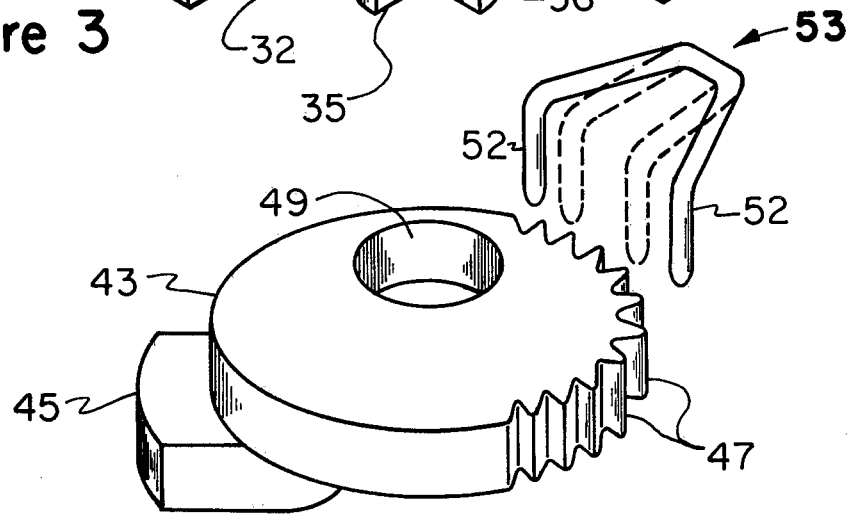
Figure 4
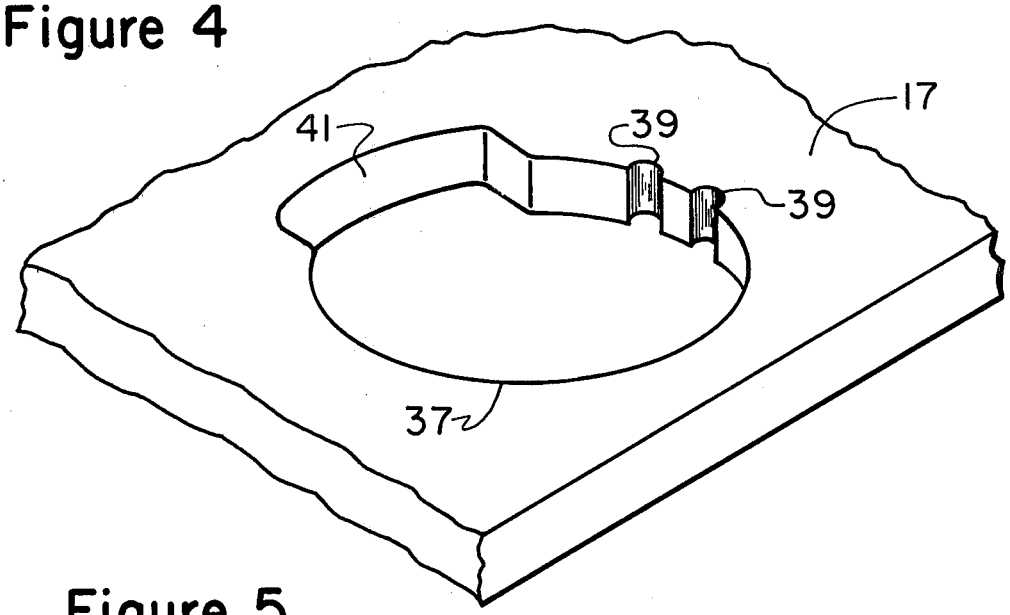
Figure 5
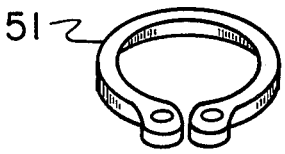

ADJUSTABLE SPRING CLIP

FIELD OF THE INVENTION

This invention relates to the area of rail securing means, and, more particularly, to a laterally adjustable attachment bracket operable to secure a resilient clip such as a Pandrol clip in position against the rail.

BACKGROUND OF THE INVENTION

The increasing depletion of world wide energy reserves has prompted a renewed interest and emphasis on developing efficient, high speed railway systems for rapid transit and freight shipment. One phase of research and development in this area has been directed toward devising a rail mounting system which would minimize routine maintenance while providing improved vibration isolation, noise reduction and electrical insulation. In many of the more modern rail systems in the United States, particularly for rapid transit, the rails are mounted directly to concrete supporting structures. The disadvantages of wooden ties or wooden ties embedded in concrete are well known. Replacement of wooden ties embedded in concrete is difficult and time consuming, and in subway systems for example, the additional vertical height required to accommodate the thickness of wooden ties results in added expense for tunnel construction.

While concrete ties generally involve less maintenance and last longer than wooden ties, so-called direct fixation systems for mounting the rails to concrete supporting structures must provide means to absorb the impact between the rail and concrete, to avoid damage to the concrete and provide energy absorption to dampen vibrations and attenuate noise. One of the most common direct fixation rail mounting systems presently in use includes a base assembly consisting of a layer of resilient absorbing elastomer disposed between and attaching to a base plate mounted to the concrete and a top plate which supports the rail. Such base assemblies have proved to be reasonably effective in minimizing deterioration of the concrete supporting structure, and reducing vibration and noise transmission to the railway cars and surrounding areas.

However, it has been found that even where the best installation procedures are used, some degree of lateral adjustment must be included in such base assembly designs to assure that the proper gauge is maintained between rails. This is particularly important in areas where the concrete supporting structures are susceptible to sinking, earthquakes or other causes of shifting. U.S. Pat. Nos. 4,062,490 and 3,868,804 to Hixson, for example, disclose base assembly structures in which the position of the rail may be laterally adjusted at the point of anchorage of the base assembly to the concrete. Threaded bolts are embedded in the concrete on opposite sides of the rail, and extend upwardly through corresponding elongated slots formed in the base plate of the base assembly. Fixed brackets or clips attaching to the top plate contact the rail and hold it securely to the base assembly. The entire base assembly including the rail is thus laterally moveable along the elongated slots and secured in the desired position with nuts tightened on to the threaded anchorage bolts.

An alternative approach is found in U.S. Pat. Nos. 3,576,293 and 3,784,097 to Landis in which the base assembly is held in a fixed position relative to the concrete supporting structure, and the brackets or clips which secure the rail are laterally adjustable along the top plate of the base assembly. As in the Hixson disclosures, threaded bolts and nuts are utilized by the Landis systems at the point of anchorage to the concrete and at the point of attachment of the rail to the top plate of the base assembly.

A problem associated with the systems of both Hixson and Landis is that over a period of time the repeated pounding of the rails against the concrete may cause loosening of the threaded bolt-nut attachments both at the anchorage points and at the rail. Due to the lateral adjustment capability in each of the prior art designs mentioned above, loosening of such attachments could result in lateral movement of the rails even in continuously welded track. This can be particularly dangerous in curves where lateral forces tending to urge the rails apart are most prevalent. Thus, continuous maintenance programs are required with such prior art systems to assure that all bolted connections remain tight. In addition, each of the patents cited above include at least one threaded bolt which extends upwardly from the concrete supporting structure and/or at the point of attachment of a bracket or clip to the rail such that the threads are exposed to the weather. As time passes, oxidation and other deterioration of the threads could present maintenance problems in loosening such attachments for lateral adjustment of the rail, or in simply tightening the nuts to the bolts as they become loosened.

In an effort to avoid the potentially substantial costs required for proper maintenance of the systems described above, resilient, one-piece metal clips including so-called Pandrol clips have been utilized as a durable, relatively maintenance-free alternative. See U.S. Pat. No. 3,910,493. The Pandrol rail clip for example, is a resilient metal bar which is bent or formed in a curved shape such that one section contacts the flange of a rail and a second section is secured to the top plate of the base assembly by some form of attachment means. Once in place, the Pandrol clip needs no adjustment, tightening or other form of maintenance unless a failure should occur requiring replacement.

At least one prior art U.S. Pat. No. 4,047,663 to Reynolds et al, has recognized the advantage of using Pandrol clips in combination with the general configuration of standard base assemblies now commonly in use as discussed above. The Reynolds et al direct rail fixation system utilizes eccentrics at the point of anchorage between the base assembly and concrete supporting structure to provide lateral adjustment of the rail. The anchor bolt extending through the eccentric is inserted into a corresponding threaded sleeve embedded in the concrete. The top plate of the base assembly is formed with generally circular notches or grooves to receive the Pandrol clip and lock it firmly into position against the rail. A disadvantage of this configuration, however, is the same as that described above in connection with the Hixson systems. If the eccentric anchorage connection should loosen after a period of time, the entire base assembly would be susceptible to shifting in response to lateral forces.

SUMMARY OF THE INVENTION

The present invention overcomes the difficulties in the prior art systems, particularly in the Hixson and Landis configurations, by providing an attachment bracket which is formed to firmly hold a Pandrol clip or similar clip in position to secure a rail and is laterally adjustable along the top plate of the base assembly with given tolerances. Anchorage of the base assembly herein is preferably accomplished by inserting a threaded bolt through a bore in the base assembly and then into a correspondingly threaded sleeve embedded in the concrete supporting structure. Unlike the prior art systems of Hixson and Landis, no threads are exposed to the elements where they could become rusted and make tightening or loosening difficult.

In addition, maintenance requirements of the subject invention are considerably less than with existing systems. The bolt-nut attachment at the rail, found in the Hixson and Landis systems, is completely eliminated. Moreover, the attachment at the point of anchorage of the base assembly to the concrete is not as critical as in the Reynolds et al disclosure. Should the anchorage bolt loosen slightly in the inventive system herein, the base assembly would still be held in place laterally as discussed in detail below. Of course increased vibration of the base assembly would occur, but there would be limited lateral movement, if any. In contrast, the Reynolds et al configuration could permit lateral movement of the entire base assembly and rail, in addition to increased vibration, should the eccentric loosen enough to rotate. Although loosening of the base plate from the concrete supporting structure results in increased vibration and noise, the primary danger of spreading of the gauge between rails is avoided by the subject invention.

Therefore it is an object of this inventionto provide a laterally adjustable bracket for securing a Pandrol clip or similar clip to a rail in a direct fixation rail mounting system.

It is another object of the present invention to provide a laterally adjustable bracket for securing a Pandrol or similar rail clip, to be used in combination with a direct fixation rail mounting system having non-adjustable fixed anchorage means to the underlying support structure.

It is a further object of the subject invention to provide a laterally adjustable bracket for securing a Pandrol or similar rail clip to a rail, which is capable of remaining in position adjacent the rail to resist lateral movement thereof independently of the rail clip.

DESCRIPTION OF THE DRAWINGS

Objects in addition to the foregoing will become apparent in view of the following description taken in conjunction with the accompanying drawings, wherein:

FIG. 3 is a perspective view in partial cross section of a portion of the fastening means herein.

FIG. 4 is a perspective view of an additional portion of the fastening means of the present invention.

FIG. 5 is a partial perspective view of the top plate of the direct fixation base assembly showing an opening formed to receive the fastening means of the subject invention.

DETAILED DESCRIPTION OF THE INVENTION

Figure 1:
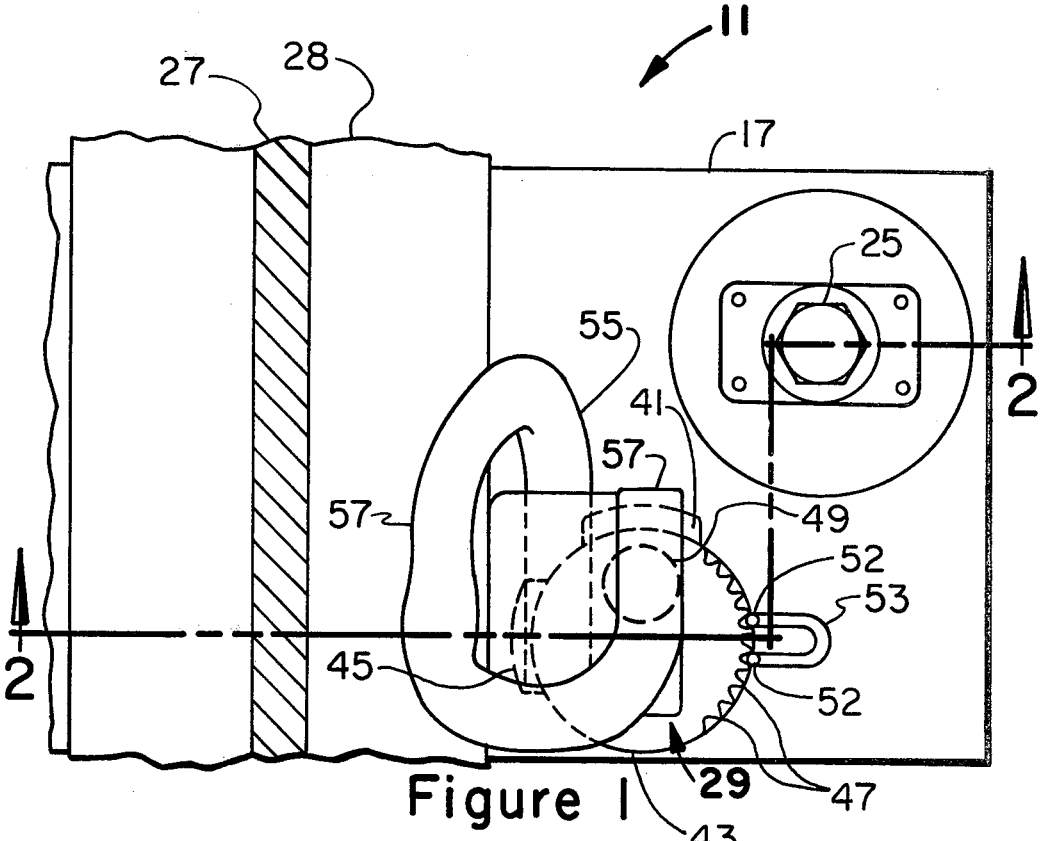
FIG. 1 is a partial top view of a direct fixation base assembly including the fastening means of the present invention.
Figure 2:
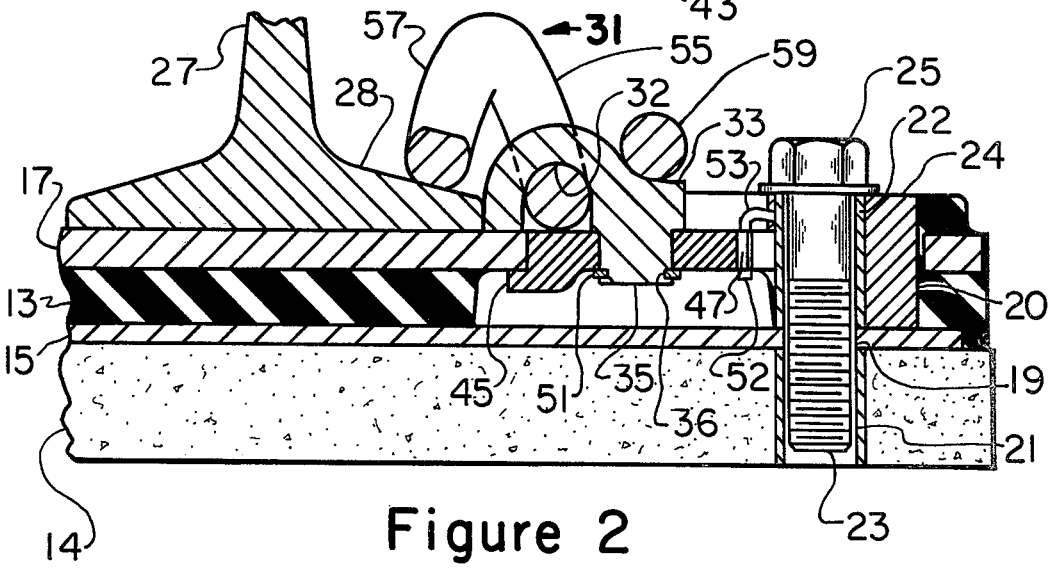
FIG. 2 is a partial cross-sectional view of a direct fixation base assembly showing a Pandrol clip held in position against the rail by the fastening means of the subject invention.

Referring now to the drawings, and in particular to FIGS. 1 and 2, a direct fixation base assembly is shown and labelled generally with the reference 11. It will be observed that FIGS. 1 and 2 are a view of one side of the base assembly 11 including the fastening means of the present invention which is discussed in detail below. It should be understood that the other side of base assembly 11 is essentially identical and the following discussion is equally applicable to the structure and operation of that portion of the base assembly 11 not shown.

A suitable support structure, preferably precast or cast-in-place concrete 14, receives and supports base assembly 11 on the track bed. The base assembly 11 includes a layer of resilient elastomeric material 13 disposed between and attaching to a base plate 15 and a top plate 17. The elastomer layer 13 may be secured to plates 15 and 17 by vulcanization, adhesive coatings or any other suitable means. A bore 19 is machined adjacent each end of base assembly 11 through the bottom plate 15. A larger bore 20 is machined in top plate 17 and elastomeric layer 13, concentric with bore 19, and receives a metal sleeve 22 attached to a plastic jacket 24 both of which bear against base plate 15. A threaded sleeve 21 is embedded in support structure 14 in alignment with bore 19 to receive a correspondingly threaded bolt 23 inserted through bore 19 and metal sleeve 22, for securely holding base assembly 11 in a fixed position on support structure 14.

No lateral adjustment of base assembly 11 relative to support structure 14 is permitted herein and only the head 25 of bolt 23 is exposed to the weather, unlike some of the prior art systems mentioned above. In addition, graphite or any other suitable coating may be applied to the threads of bolt 23 and sleeve 21 to resist oxidation and permit tightening and loosening of bolt 23 within sleeve 21 after extended periods of time should the need arise.

A standard rail 27 is disposed on top plate 17 directly above the elastomer layer 13. As is well known, the elastomer layer 13 allows base assembly 11 to deflect in response to forces applied to rail 27 which reduces vibration and noise. Rail 27 is removably secured to base assembly 11 by a resilient rail clip such as a Pandrol clip 31, which, in turn, is held in place by the laterally adjustable fastener 29 of the present invention. As shown in FIG. 3, fastener 29 consists of a generally rectangular strip of steel or an equivalent which is bent to form a curved section 32 at one end and a generally planar bearing surface 33 at the other end. Extending downwardly from the underside of bearing surface 33 is a shaft 35.

A circular cut-out 37 is machined or punched into top plate 17, which includes a pair of semi-circular grooves 39 and a recess 41 spaced at approximately a 90° interval about its circumference. Cut-out 37 is formed to receive a circular disc 43, which includes a lip 45 extending outwardly from the bottom surface, and a plurality of teeth 47 formed on the circumference of one side at a 180° interval from lip 45. In addition, a bore 49, having a diameter slightly greater than that of shaft 35, is drilled or punched in disc 43 at a location offset from its center.

The elements of FIGS. 3–5 are assembled with base assembly 11 in the manner shown in FIG. 2. The shaft 35 of fastener 29 is inserted into the bore 49 of disc 43 and a retaining ring 51 (See FIG. 5) is secured within a groove 36 formed in the end of shaft 35 to hold fastener 29 and disc 43 securely together. Disc 43 is placed into the cut-out 37 of top plate 17 such that the lip 45 passes through recess 41, and then rotated counterclockwise about 90°, to place lip 45 into engagement with the underside of top plate 17 and the teeth 47 into alignment with grooves 39.

At this point, disc 43 is free to rotate within cut-out 37 of top plate 17. Since bore 49 is offset from the center of disc 43, rotation of disc 43 will cause lateral movement of fastener 29 along top plate 17. As disc 43 is rotated in the clockwise direction for example, fastener 29 moves laterally to the right (See FIG. 1) or toward the edge of base assembly 11 and away from rail 27. Once rail 27 is placed in the desired position on base assembly 11, disc 43 may be rotated in either direction until the end of fastener 29 adjacent curved section 32 abuts the rail 27. Both the disc 43 and fastener 29 are locked in position relative to rail 27 by inserting the legs 52 of a spring clip 53 into the grooves 39 of top plate 17. Legs 52 are sized to extend outwardly from grooves 39 to engage teeth 47, thus preventing rotation of disc 43.

Once disc 43, and, in turn, fastener 29 are locked in position on top plate 17, a resilient rail clip as Pandrol clip 31 may be driven into place. As shown in FIGS. 1 and 2, a straight section 55 of Pandrol clip 31 is inserted between the curved section 32 of fastener 29 and the upper surface of disc 43. First and second bearing sections 57 and 59 of Pandrol clip 31 contact the flange 28 of rail 27 and the bearing surface 33 of fastener 29, respectively. The curved section of fastener 29 holds Pandrol clip 31 laterally in place, and in cooperation with the lip 45 of disc 43 also resists upward movement of the Pandrol clip 31 which occurs as the rails in front of an approaching vehicle deflect upwardly in response to the leverage action from localized vertical forces applied to the rails by the vehicle wheels. The first bearing section 57 of Pandrol clip 31 securely holds rail 27 in place on top plate 17, and the second bearing section 59 contacts the bearing surface 33 of fastener 29.

If lateral adjustment of rail 27 is necessary as a result of shifting of the support structure 14 or for any other reason, fastener 29 may be moved laterally along top plate 17 by first removing Pandrol clip 31 and spring clip 53 and then rotating disc 43 in either direction as required.

The Pandrol clip 31, or any resilient rail clip of similar configuration, is thus securely held to the rail 27 and base assembly 11 by the laterally adjustable fastener 29 of the present invention. Unlike the prior art devices, there are no nut and bolt connections herein at either the rail 27 or at the anchorage points to the support structure 14, and no threads are exposed to weather. In addition, an important advantage of the present invention is that should the Pandrol clip 31 fail and become detached from rail 27, lateral movement of the rail 27 will be independently prevented by fastener 29. The generally straight end of fastener 29 adjacent curved section 31 abuts rail 27 and is held in that position by disc 43. Although increased vibration and noise would result if Pandrol clip 31 fails, the critical lateral spacing between rails will be maintained by fastener 29.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. In a base assembly for removeably mounting a rail on a support structure, said base assembly including a layer of resilient elastomeric material disposed between and attaching to a base plate and a top plate, said base assembly having anchoring means adjacent each end for attaching said base assembly in a fixed position to said support structure, said rail being positioned on said top plate and being secured thereto by a pair of resilient rail clips disposed on opposite sides of said rail, said rail clips having an anchoring section and first and second bearing sections, said top plate having a cut-out on opposite sides of said rail, a pair of grooves being formed in said top plate about the circumference of said cut-out, the improvement comprising laterally adjustable rail clip fastening means, said rail clip fastening means including:

a pair of sections of rigid material each having a curved portion at one end and a straight portion, said sections having a shaft attached to the underside of said straight portion at a point offset from the center thereof;

a pair of discs for insertion into said cut-outs of said top plate on opposite sides of said rail and being rotatable therewithin, said discs being formed with a bore offset from the center and having a plurality of teeth along a portion of the circumference thereof, said shaft of said sections of rigid material being inserted into said bore of said discs and being held thereto by retainng means, said disc being inserted within said cut-outs such that said teeth align with the grooves of said cut-outs whereby rotation of said discs within said cut-outs moves said sections of rigid material laterally along said top plate, said discs being rotatable to move said sections of rigid material into contact with said rail for resisting lateral movement thereof; and a pair of locking means insertable within said groove and extending outwardly into engagement with said teeth of said discs on opposite sides of said rail, said locking means preventing rotation of said discs within said cut-outs and thus securing said sections of rigid material from lateral movement along said top plate, whereby said anchoring section of each of said rail clips is inserted within said curved portion of said sections of rigid material on each side of said rail to securely hold said rail clips in a position wherein said first bearing section contacts said rail, and in cooperation with said rail clip fastening means prevents movement of said rail relative to said base assembly.

2. The rail clip fastening means of claim 1 wherein said discs include a lip extending outwardly from the underside thereof, said lip bearing against the underside of said top plate as said discs are inserted within said cut-outs to provide resistance to upward movement of said sections of rigid material exerted by said anchoring section of said rail clips.

3. The rail clip fastening means of claim 1 wherein said locking means are spring clips having a pair of spaced leg portions, said leg portions being insertable within said grooves and extending outwardly to engage said teeth of said discs to prevent rotation thereof and thus prevent lateral movement of said sections of rigid material.

4. The rail clip fastening means of claim 1 wherein said retaining means is a ring formed to engage a groove formed in the base of said shaft and securely hold said shaft within said bore of said disc.

* * * * *